US007377383B2

(12) United States Patent
Henry

(10) Patent No.: US 7,377,383 B2
(45) Date of Patent: May 27, 2008

(54) MULTI-CHAMBER CONTAINER FOR MIXING INGREDIENTS AT TIME OF USE

(76) Inventor: John R. Henry, P.O. Box 1128, Fajardo, PR (US) 00738

( * ) Notice: Subject to any disclaimer, the term of this patent is extended or adjusted under 35 U.S.C. 154(b) by 229 days.

(21) Appl. No.: 11/167,437

(22) Filed: Jun. 27, 2005

(65) Prior Publication Data

US 2006/0289316 A1 Dec. 28, 2006

(51) Int. Cl.
*B65D 25/08* (2006.01)
*B65D 6/28* (2006.01)
*B67D 5/60* (2006.01)

(52) U.S. Cl. ..... 206/222; 220/4.27; 222/83; 222/129; 222/145.1

(58) Field of Classification Search ..... 206/219, 206/222; 220/4.26, 4.27, 23.6; 222/80, 222/83, 129, 144, 145.1, 145.2; 426/115–120
See application file for complete search history.

(56) References Cited

U.S. PATENT DOCUMENTS 2,631,521 A * 3/1953 Atkins, Jr. ..... 206/222
3,347,410 A 10/1967 Schwartzman
3,349,966 A 10/1967 Schwartzman
3,404,811 A * 10/1968 Cernei ..... 222/129
3,443,726 A 5/1969 Muller et al.
3,548,562 A 12/1970 Schwartzman
3,610,586 A 10/1971 Price et al.
3,809,289 A * 5/1974 Komendowski ..... 222/83
4,067,440 A * 1/1978 Lataix ..... 206/222
4,177,938 A 12/1979 Brina
4,244,467 A 1/1981 Cavazza
4,271,982 A * 6/1981 Niksich et al. ..... 222/83
4,638,927 A 1/1987 Morane
4,682,689 A 7/1987 Pereira et al.
4,693,366 A 9/1987 Goncalves
4,785,931 A 11/1988 Weir et al.
4,823,946 A 4/1989 Stoeffler et al.
4,936,445 A 6/1990 Grabenkort
5,071,034 A 12/1991 Corbiere
5,152,965 A 10/1992 Fisk et al.
5,277,303 A 1/1994 Goyet et al.
5,405,051 A * 4/1995 Miskell ..... 222/145.1
5,411,295 A 5/1995 Bates et al.
5,514,394 A * 5/1996 Lenahan ..... 426/120
5,647,481 A 7/1997 Hundertmark et al.
5,884,759 A 3/1999 Gueret
5,890,596 A 4/1999 Albisetti (Continued)

*Primary Examiner*—Bryon P Gehman
(74) *Attorney, Agent, or Firm*—James C. Simmons

(57) ABSTRACT

A mixing container wherein two or more chamber members each contain a material to be mixed. A first chamber member has a threaded port. A second chamber member has a threaded neck which is threadedly receivable in the port to threadedly connect the chamber members. The neck has a terminal opening. A sealing member covers the opening. The first chamber member has a frangible portion which sealingly closes an inner end of the port and which is broken is as the neck bears there against as the neck is threadedly received in the port. A blade on the first chamber member punctures the neck sealing member as the neck sealing member bears against the blade as the neck is threadedly received in the port. This allows the materials in the chamber members to flow between the chamber members to be mixed. The container may also have an opening for dispensing the substance mixed therein.

19 Claims, 3 Drawing Sheets

U.S. PATENT DOCUMENTS 6,065,641 A 5/2000 Laguna Valderrama
6,068,396 A 5/2000 Baudin
6,073,803 A 6/2000 Sturm et al.
6,135,275 A 10/2000 Kelders et al.
6,247,586 B1 6/2001 Herzog et al.
6,543,645 B2 * 4/2003 Lacout ..... 222/129
6,609,634 B2 8/2003 De Laforcade et al.
6,634,821 B2 10/2003 Gueret
6,814,229 B2 * 11/2004 Seckler ..... 206/222
6,910,573 B2 * 6/2005 Deans ..... 206/222
6,935,493 B2 * 8/2005 Cho ..... 206/222
7,066,323 B1 * 6/2006 Reisman ..... 206/222
2002/0104766 A1 8/2002 De Laforcade
2002/0130126 A1 * 9/2002 Rosenberg ..... 220/4.26
2002/0150658 A1 10/2002 Morrissette et al.

* cited by examiner

MULTI-CHAMBER CONTAINER FOR MIXING INGREDIENTS AT TIME OF USE

The present invention relates generally to bottles or containers. More particularly, the present invention relates to a container which allows ingredients to be mixed to form a product, which is then dispensed from the container or otherwise suitably used. For example, such a container may be used to allow a customer to mix ingredients such as peroxide/activator and dye to form a hair coloring and then dispense the hair coloring through an opening in the container.

An example of a current container system for mixing and dispensing hair coloring is one which contains in two bottles the dye and peroxide/activator respectively. To use, a customer opens both bottles and pours the dye from one bottle into the bottle containing the peroxide/activator. He or she then recaps the peroxide bottle, shakes it to mix the ingredients, then pours the mixed hair coloring onto his or her hair.

It is considered desirable to keep the hair coloring components separate until time of use but which require no assembly by the consumer. There have been many attempts to provide such a container.

U.S. Pat. No. 6,065,641 discloses a cartridge which includes two end-to-end cylindrical housings the end of one having a membrane over a reduced diameter outlet at the inward end of the outlet, and the end of the other housing having a hollow needle which is received in the outlet to puncture the membrane and allow communication of liquids between the housings when they are slid relatively toward each other. A seal is fitted in an outer peripheral zone between the housings to prevent the housings from closing on each other, whereby the membrane cannot be broken by such sliding movement until after the seal is removed.

U.S. Pat. No. 3,443,726 discloses a mixing and dispensing container (which may be used for hair colorants) in which a can unit, which includes a bottle-receiving threaded collar, is filled with contents and sealed by use of a frangible plug, which has a score line. The bottle is screwed or locked in a fixed position in the collar to seal the bottle, and the contents of the can and bottle are separated from each other by the plug. Upon further rotation of the bottle relative to the can, a neck extension or nose on the bottle pushes a knock-out portion of the plug into the can, allowing mixing of the contents of the can and bottle. The mixed contents may then be dispensed through an opening in the bottle. A sealing tape covers portions of the can seam and bottle neck to display a twisted or fractured appearance to a consumer if the can and bottle have been rotated with respect to each other after packaging thereof. Both the can and bottle may be made from plastic. See also U.S. Pat. No. 4,823,946.

U.S. Pat. No. 5,071,034 discloses a distributing device for liquid preparation which is composed of a receptacle and reservoir each containing a liquid and joined by a bellows. The bellows has arranged within it two impervious membranes which separate the liquids and which is separated by a perforation device which is perpendicular to the membranes and has two sharpened extremities to puncture the membranes to allow mixing of the liquids when pressure is exerted on the bellows.

U.S. Pat. No. 4,693,366 discloses packaging comprising a container and cap each containing a product to be mixed with the other at the time of use and separated from each other by two diaphragms fixed to the cap, which has a stopper. In order to provide communication between and mix the contents, the stopper is removed and replaced with a perforator cap, which has a cutter blade. When the perforator is positioned on the cap, the blade slashes the diaphragms to allow mixing of the products. The mixed product may then be released through a nozzle in the perforator cap.

U.S. Pat. No. 4,936,445 discloses a dual container system to effect intermixing of the contents of two containers by external manipulation after the containers are joined by means of threads. Ratchet teeth are provided to allow relative rotational movement in one direction of rotation only during which the ratchet teeth of one peripheral surface slide over the ratchet teeth of the other.

Additional examples of mixing and dispensing containers may be found in U.S. Pat. Nos. 3,347,410; 3,349,966; 3,548,562; 3,610,586; 4,177,938; 4,244,467; 4,638,927; 4,682,689; 4,785,931; 5,152,965; 5,277,303; 5,647,481; 5,884,759 (reissued as Re38,067); 6,068,396; 6,073,803; 6,135,275 and U.S. patent application publication 2002/0104766.

The above mixing and dispensing containers are either complex or difficult to manufacture, difficult for the customer to use, expensive to manufacture, or are otherwise less than desirable.

Accordingly, it is an object of the present invention to provide a mixing container which is assembled at the place of manufacture so that it has the appearance to the consumer of a single bottle.

It is a further object of the present invention to provide such a container which is simple and foolproof to manipulate in accordance with easy to understand instructions for mixing the ingredients.

It is yet another object of the present invention to provide such a container which may be made cost effectively on standard plastic molding machinery.

It is another object of the present invention to provide such a container which provides a positive indication that the container ingredients have been activated.

In order to provide such a container, in accordance with the present invention, the container has two (or more) chamber members each of which has a frangible seal. The chamber members are provided to the customer in position for threadedly connecting thereof. The chamber members are threadedly connected, by twisting one relative to the other by the customer, with the seals thereof in position relative to each other so that materials may flow between the chamber members for mixing when the seals are broken. As the chamber members are threadedly connected, the seals are broken to allow passage of the ingredients between the chamber members. The customer may then mix the ingredients by shaking the container. After mixing, the product may then be dispensed by the customer through an opening in one of the chamber members or otherwise suitably used.

The above and other objects, features, and advantages of the present invention will be apparent in the following detailed description of the preferred embodiment, when read in conjunction with the appended drawings wherein the same reference numerals depict the same or similar parts throughout the several views.

DETAILED DESCRIPTION OF THE PREFERRED EMBODIMENT

Figure 1:
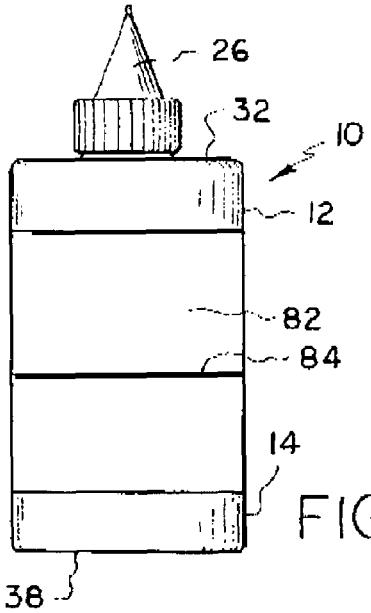
FIG. 1 is a side elevation view of a container which embodies the present invention, illustrated in condition for sale to a customer.
Figure 2:
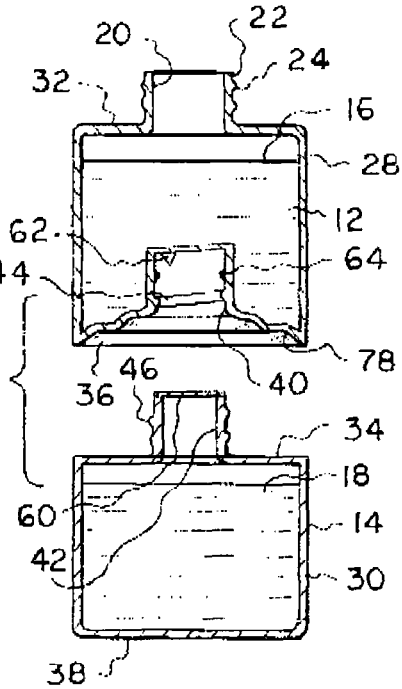
FIG. 2 is a sectional exploded view of a pair of chambers for the container.
Figure 3:
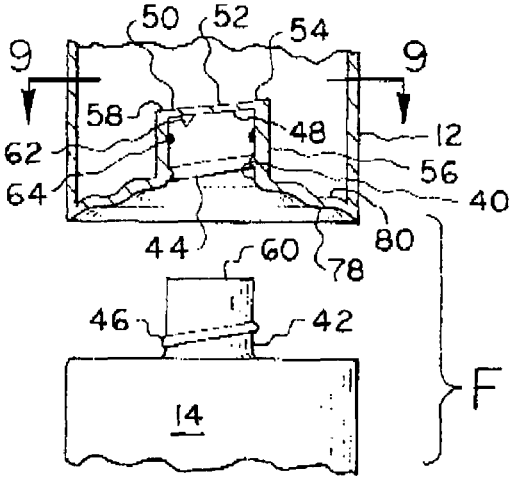
FIG. 3 is a partial exploded enlarged view, partly elevational and partly sectional, illustrating the interface between the chambers.

Referring to FIGS. 1 to 6 and 9, there is shown generally at 10 a container in the form or appearance of a bottle having a pair of upper and lower chamber members 12 and 14 each containing a liquid (or other suitable material), illustrated at 16 and 18 respectively, to be mixed and the resultant mixture dispensed through outlet 20 in the upper end of upper chamber member 12. For example, the liquids 16 and 18 may be peroxide/activator and dye respectively which, when mixed, form a hair coloring to be dispensed (poured or accessed) through opening 20 onto a customer's hair. The outlet 20 is conventionally in the form of a neck 22 having external threads, illustrated at 24, which threadedly receive an internally threaded screw cap 26, which is desirably of a construction which allows it to be applied inexpensively by standard capping machinery, for closing thereof. However, the outlet 20 may be closed by any other suitable closure, such as, but not limited to, a plug, snap cap, membrane, or metal lid.

In accordance with the present invention, it is not required that the mixture be dispensed from the container. Thus, there are applications of the present invention which do not require dispensing, for example, heating or cooling packs or light sticks.

The chamber members 12 and 14 are shown to each be cylindrical with a cylindrical vertical wall 28 and 30 respectively, a generally flat upper roof or ceiling portion 32 and 34 respectively, and a generally flat lower floor 36 and 38 respectively, the wall extending vertically between the respective roof and floor. The vertical wall 30 is desirably normal to the upper chamber roof 32 and the lower chamber floor 38, which are accordingly horizontal. The diameters of the walls 28 and 30 are desirably equal so as to provide the pleasing bottle appearance shown in FIG. 1 when the chamber members 12 and 14 are connected as discussed hereinafter. However, the chambers 12 and 14 may be of any other suitable size and shape.

The chamber members 12 and 14 may desirably be composed of molded plastic material which allows them to be cost effectively manufactured on standard plastic molding machinery, and the bottle 10 may be filled and assembled cost effectively, as discussed hereinafter, on generally standard packaging machinery. The small number of bottle parts also helps to keep the manufacturing cost low. The chambers 12 and 14 may however be fabricated from any other suitable materials, such as, for example, metal, glass, composite materials such as carbon fiber, or flexible materials such as flexible bags.

The lower chamber 14 has a cylindrical neck or spout or nozzle 42 which extends from its roof 34 and which is receivable in a cylindrical port or recess 40 in the upper chamber floor 36. It should however be understood that, alternatively, the neck may be on the upper chamber 12 while the port may be in the lower chamber 14. The port 40 is shown recessed into the upper chamber 12. However, in the event that drainage of the upper chamber 36 into the lower chamber 14 is desired or if otherwise desired, the port 40 may be located externally. The diameters of the neck 42 and the port 40 are substantially equal (the neck diameter being slightly less than the port diameter) to afford a desirably generally tight or snug slip or press or friction fit therebetween which allows the chambers 14 and 16 to be held together prior to connecting the chambers as discussed hereinafter with respect to FIG. 6 but which allows manipulation of the chambers for such connection.

Figure 6:
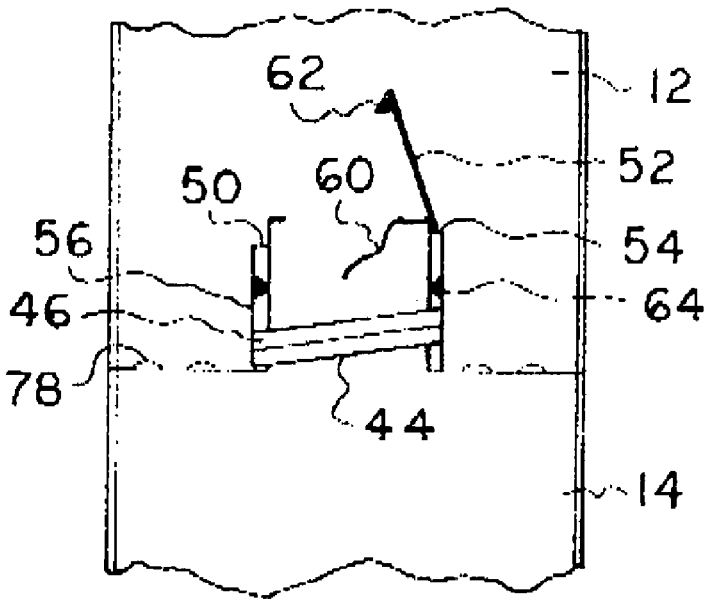
FIG. 6 is a partial view similar to that of FIG. 5 illustrating the container after activation thereof.

A thread, illustrated at 44, is molded or otherwise suitably provided on the port 40, and a mating thread, illustrated at 46, is molded or otherwise suitably provided on the neck 42 for threadedly connecting the chamber members 12 and 14, as seen in FIG. 6.

Figure 9:
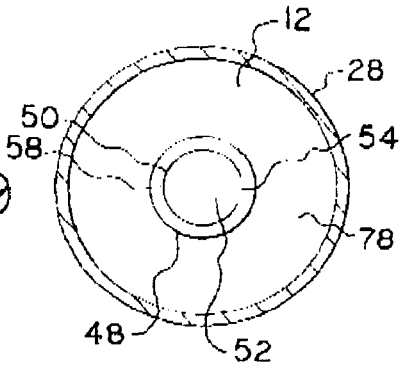
FIG. 9 is a sectional view of the container taken along lines 9-9 of FIG. 3.

The inner end of the port 40 is sealingly closed by a frangible wall 48, i.e., the wall 48 has a frangible or breakaway disc 52 defined by a score line, illustrated at 50 in FIG. 9, or formed by other suitable means such as angling. The score line 50 does not extend entirely around the disc 52 thereby leaving a hinge portion, illustrated at 54, so that the disc can remain attached, as illustrated in FIG. 6, to prevent it from floating free in the chamber 12. The breakaway may be otherwise suitably constructed. For example, the score line may be extended entirely around the disc when it is desirable to break the disc completely loose from the port. The breakaway disc 52 is slanted slightly relative to the cylindrical wall 56 of the port 40 so that the wall 56 is desirably lowest or shortest at the point, illustrated at 58, opposite the hinge portion 54 thereby allowing initial contact with the disc 52 at the point 58 opposite the hinge portion 54 for effective breaking and lifting of the disc 52.

The neck 42 is molded to have an open terminal end, which is thereafter covered, to keep the chamber 14 sealed until the time of activation, by a sealing but easily pierceable frangible membrane 60 such as, for example, plastic or aluminum foil. The membrane 60 is suitably attached to the neck 42 such as by an adhesive. A pointed member or knife or blade 62 is molded into the outer surface of the breakaway member 52 for piercing the seal 60 to allow the release of the fluid 18 from chamber 14 as the neck 42 is screwed into contact with the blade 62. If desired, the blade 62 may be a separate member suitably attached to the disc 52. The blade 62 is shown as a pointed member located at the position 50, but it may be otherwise suitably positioned and shaped, for example, it may extend a substantial distance around the circumstance of the breakaway disc 52 to provide more effective tearing away of the membrane 60.

A bead ring 64 is molded around the outer surface of the port cylindrical wall 56 to seal the connection of the chambers 12 and 14 to prevent leakage.

Figure 4:
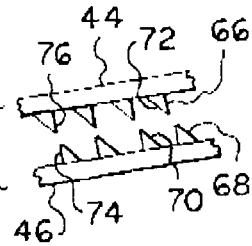
FIG. 4 is a detail view of threads for the chambers.

Referring to FIG. 4, a plurality of ratchet members 66 are molded into the thread 44, and a plurality of mating ratchet members 68 are molded into the thread 46. Altrnatively, the ratchet members 66 and 68 may be molded onto the port 40 and neck 42 respectively. The ratchet members 66 interlock with the ratchet members 68 to enforce one-way movement and thus to resist unscrewing or prevent unintentional unscrewing of the threaded connection. Thus, as the thread 46 is screwed relative to thread 44, the slanted engaging surfaces 70 and 72 thereof respectively allow the screwing to occur. However, the substantially squared surfaces 74 and 76 respectively thereof, which engage during attempted unscrewing, are provided to prevent unscrewing of the connection. Alternatively, the port lug or thread 44 may be suitably provided with a detent so that, when rotation is complete, the neck lug or thread 46 will snap into or beyond the detent to prevent accidental disassembly as well as to provide an indication that the chamber members have been completely screwed together.

Figure 5:
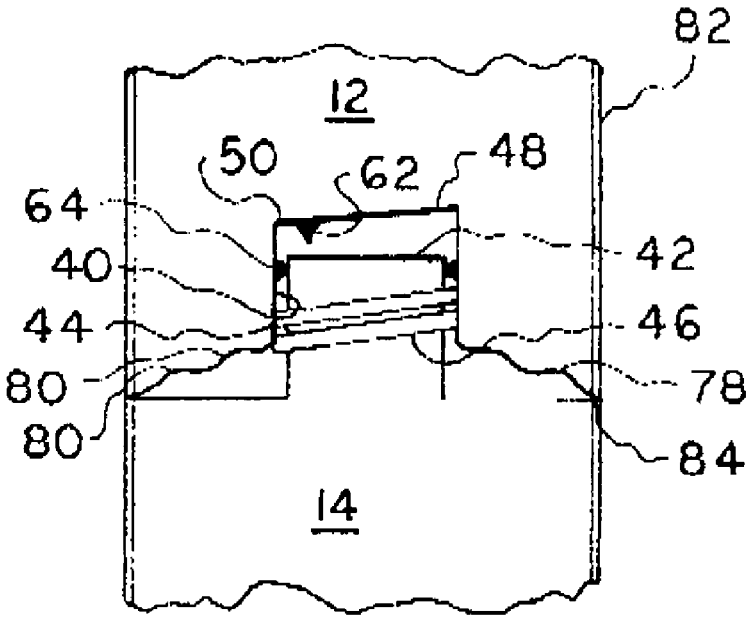
FIG. 5 is a partial schematic view illustrating the chambers in position for sale of the container, inactivated, to customers.

The chamber wall 28 extends below the port wall 56 a distance equal substantially to the height of the neck 42 so that the bottle 10 may be sold and kept prior to activation with substantially no space between the chamber cylindrical walls 28 and 30, as seen in FIG. 5. The chamber 12 has a collapsible dished bottom wall 78 extending between the bottoms of the cylindrical port and chamber walls 56 and 28 respectively, i.e., the bottom wall 78 extends at an angle between the port and chamber walls 56 and 28 respectively which gives it the appearance of a dish and is adapted to be collapsible into a generally flat configuration as illustrated in FIG. 6. The dished wall 78 is desirably corrugated, as illustrated by corrugations 80, to provide such collapsibility and thus aid in pulldown when activating, as seen in FIG. 6. If desired, the bottoms of the chamber walls 56 and 28 may be in alignment horizontally, and the wall 78 (which need not then be collapsible or require pulldown) may accordingly be flat to provide a gap between the chambers prior to activation as a visual indication of integrity, i.e., that the bottle has not been activated.

Referring to FIGS. 1 and 5, there is shown the bottle 10 inactivated and packaged for sale. The two chamber members 12 and 14 may be filled and closed on conventional filling lines. At the end of the line the chamber member 14 will be mounted to the chamber member 12. The neck 42 of the lower chamber 14 is press or friction fit into the port 40 of the upper chamber 12 so that the neck thread 46 abuts the port thread 44, the upper end of the neck 42 is within the sealing bead 64, the upper end of the lower chamber cylindrical wall 30 engages the lower end of the upper chamber cylindrical wall 28 so that there is no gap therebetween, and the foil membrane 60 is just out of engagement with the blade 62. The threads are located in accordance with principles commonly known to those of ordinary skill in the art to which the present invention pertains to prevent the blade 62 from engaging the membrane 60 prior to the act of screwing the neck 42 into the port 40. The slip fit is provided to hold the chamber members 12 and 14 together temporarily until label 82 is applied, as hereinafter discussed, to securely hold them together until the time of activation. The thusly assembled container 10 is shipped and ultimately sold to the end user with the fluids 16 and 18 remaining segregated and unmixed.

The container 10 may, if desired, be provided with a skirt to allow the container 10 to be free-standing. The skirt may be molded into the container 10 or may be a separate piece attached thereto.

When the chambers 12 and 14 are assembled (with the container 10 inactivated) at the time of manufacture, the chamber 12 should normally provide protection against accidental puncture of the membrane 60. In some cases such as for medical infusion products, it may be desirable to distribute the two chambers 12 and 14 separately. The thusly exposed membrane 60 may then be exposed to accidental puncture. In order to protect the exposed membrane 60, an overcap of plastic or other suitable material may be provided on the neck 42 to protectively cover the membrane 60. The neck 42 may be provided with threads or a lip to permit screwing or snapping of the overcap, which would be removed by the end user prior to assembly of the chambers 12 and 14.

Referring to FIG. 6, the bottle 10 is easily and quickly activated by a customer by twisting the lower chamber 14 relative to the upper chamber 12 to screw the neck 42 further into the port 40, as seen by the neck thread 46 being to the inside of the port thread 44 in FIG. 6. During this movement, the corrugated wall 78 is pulled down to the position shown in FIG. 6. This movement causes the foil membrane 60 to engage the blade 62 and thus become torn thereby allowing release of the fluid 18 from the lower chamber 14. This movement also causes the neck 42 to ram into the breakaway portion 52 initially near point 58 to break the portion 52 along score line 50 causing the breakaway portion 52 to swing upwardly thereby allowing release of the fluid 16 from the upper chamber 12. As seen in FIG. 6, the mere twisting of the lower chamber 14 relative to the upper chamber 12 thus effects the opening of the chambers to each other to easily and quickly allow the intermixing of the fluids 16 and 18 by the customer shaking the activated bottle 10, which mixture can then be poured through upper opening 20. The mating ratchet portions 66 and 68 on the threads 44 and 46 resist loosening or disconnection of the connection, and the seal 46 acts to prevent escape of the mixture from the bottle 10 except through opening 20.

After the bottle 10 is assembled as shown in FIG. 5, a label 82 is suitably placed about the bottle 10, as illustrated in FIG. 1, so that it is attached to both the lower and upper chambers 12 and 14 respectively to aid in holding the chambers 12 and 14 in the desired unactivated position during shipment and handling to thereby prevent accidental activation as well as to prevent separation of the chambers 12 and 14. The label 82 also serves as an indicator or evidence of whether the bottle 10 has been activated, i.e., if the label 80 is torn or broken, it indicates that the lower chamber 14 has been twisted relative to the upper chamber 12 and that the bottle 10 may have been activated. The label is preferably scored or perforated, as illustrated at 84, along the intersection or junction of the chambers 12 and 14 to allow the tearing of the label 80 along the score line 84 (the offset upper and lower portions of the label 82 serving as an activation indicator) to facilitate activation and for a more pleasing activated bottle appearance. Arrows may be included on the parts of the label 80 on opposite sides of the score line 84 (or junction between chambers) which align when activated as a further indicator that the container 10 has become activated.

Figure 7:
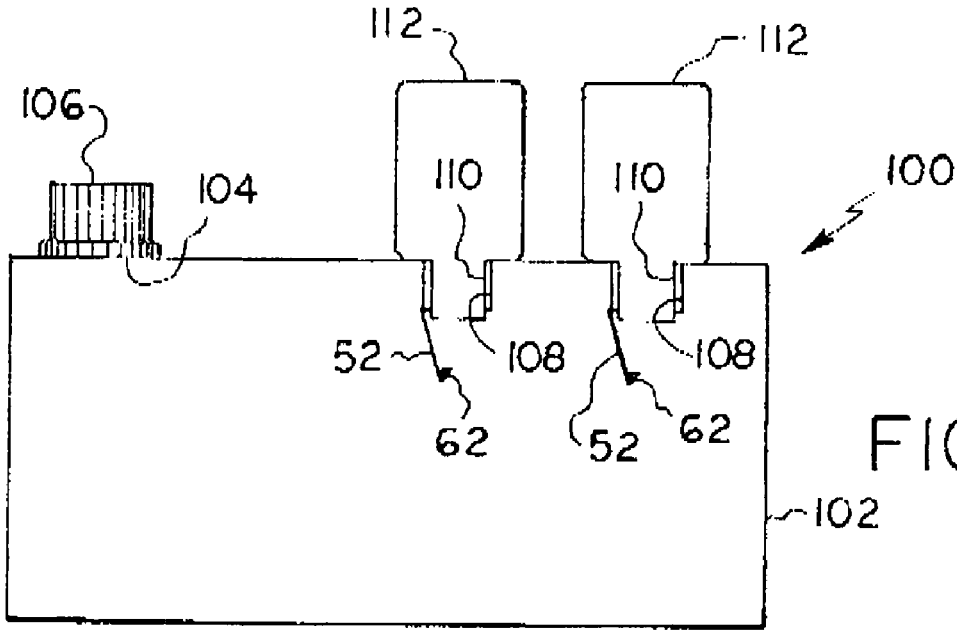
FIGS. 7 and 8 are schematic illustrations of alternative embodiments of the present invention.

Referring to FIG. 7, there is illustrated generally at 100 a container, activated, in accordance with an alternative embodiment of the present invention. The container 100 includes a lower chamber member 102 having an opening 104 for dispensing therefrom a mixture mixed in the container 100. The opening 104 may have a screw-style or other suitable closure 106. The container 100 also has a plurality (two shown) of ports 108, which may be similar to port 40, which receive the necks 110, which may be similar to necks 42, of upper chamber members 112. Thus, container 100 with a chamber member 102 having multiple ports 108 (located on the top, side, and/or top of the member 102) is provided to mix any number of liquids or other substances for dispensing of the mixed product out the opening 104.

Figure 8:
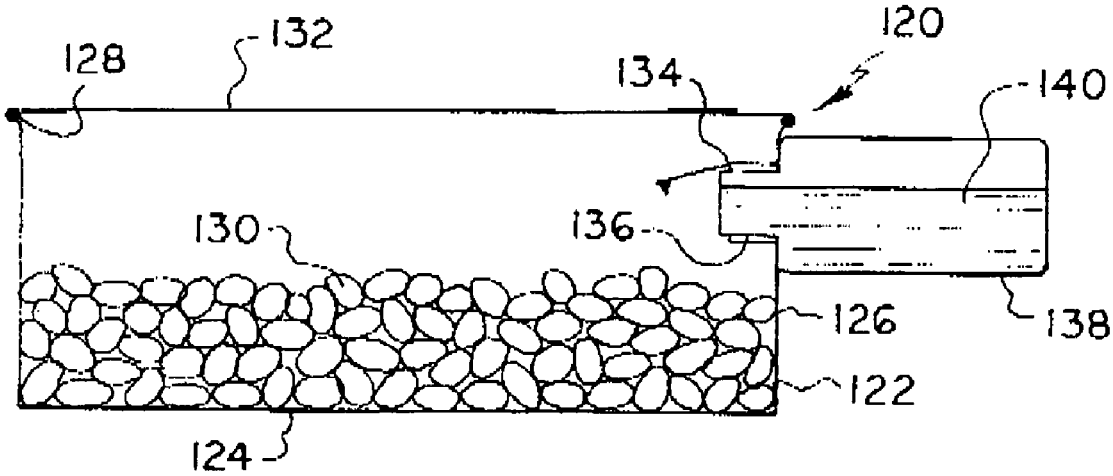

Referring to FIG. 8, there is illustrated generally at 120 a combination of a disposable plastic cereal bowl 122 and a disposable plastic chamber or bottle 138 containing milk, illustrated at 140, in accordance with an alternative embodiment of the present invention. The milk may be UHT (ultra-high temperature) milk to thus eliminate the need for refrigerated storage. The bowl 122 has a bottom wall 124 and a circular side wall 126 extending upwardly therefrom to an upper opening, illustrated at 128. The bowl 122 may be otherwise suitably shaped such as with 4 side walls instead of the circular wall. The bowl 122 may alternatively have a spout so the cereal can be slurped from the bowl thus eliminating the need for a spoon and perhaps also a wrapper (i.e., less packaging components so that the product may be less expensive) and allows one-handed use, facilitating eating on-the-go. The bowl 122 contains cereal, illustrated at 130, and its upper opening 128 is covered with foil, illustrated at 132, or other suitable protective membrane or sheet. The bowl 122 has in its side wall 126 a port 134, which may be similar to port 40, which receives the neck 136, which may be similar to neck 42, of chamber member 138. This allows milk to be mixed with cereal and eaten while on-the-go by commuters, travelers, and students easily and quickly, without fear of spilling, by twisting the chamber member 138 to activate the container 120 and turning the container 120 on its side to allow the milk 140 to be mixed with the cereal 130, then removing the foil 132, then eating. The milk bottle 138 may remain in place to act as a handle for ease in handling. Soups, stews, and the like may similarly be provided for eating on-the-go, perhaps adapting technologies such as used for military rations.

In addition to hair coloring and breakfast cereals, examples of other uses for such a container include, but are not limited to, products such as fiberglass wherein an activator is added to and mixed with a resin prior to use (perhaps with the incorporation of a brush, roller, or other applicator in the container so that the resin can be activated, mixed, and applied without the need to remove product from the container for application), medical pharmaceutical products such as dry products requiring reconstitution with water prior to use or infusion therapies such as wherein an active compound is added to an IV bag, paint color mixing wherein a neutral base is mixed with a color or tint, heating or cooling packs, and light sticks.

It should be understood that, while the present invention has been described in detail herein, the invention can be embodied otherwise without departing from the principles thereof. For example, the chamber members can be made in varied shapes and sizes and of varied materials. Such other embodiments are meant to come within the scope of the present invention as defined by the appended claims.

What is claimed is:

1. A mating pair of first and second chamber members which are connectable to form a mixing container, said first chamber member having a threaded port, a first frangible member sealingly closing an inner end of said port, said second chamber member having a threaded neck adapted for threadedly engaging said port to thereby define a threaded connection of said first and second chamber members, a second frangible member sealingly closing an outer end of said neck, a breaking member on said first frangible member for breaking said second frangible member, wherein each of said first and second chamber members is composed of molded plastic and wherein at least one of said first and second frangible members is integrally molded with a respective one of said first and second chamber members, whereby said neck can be threadedly advanced in said port to effect breakage of said first frangible member by said neck and to effect breakage of said second frangible member by said breaking member on said first frangible member to allow flow of contents between said first and second chamber members, wherein said port has a cylindrical wall, and a score line molded into and extending partially around said first frangible member thereby defining a breakaway disc having an unscored hinge portion, said breakaway disc, being slanted relative to said port cylindrical wall to allow initial contact by said neck with said breakaway disc at a location opposite said unscored hinge portion.

2. A mating pair of chamber members according to claim 1 further comprising a label applied to both said first and second chamber members.

3. A mating pair of chamber members according to claim 1 wherein one of said first and second chamber members comprises a bowl of cereal and wherein an other of said first and second chamber members contains milk.

4. A mating pair of chamber members according to claim 1 wherein said port has a cylindrical wall, said first chamber member has a cylindrical wall which extends beyond said port cylindrical wall a distance equal substantially to a height of said neck, said first chamber member has a wall which extends between said port cylindrical wall and said first chamber member cylindrical wall and which is collapsible to allow screwing of said neck into said port.

5. A mating pair of chamber members according to claim 1 wherein said first frangible sealing member is an integrally molded portion of said first chamber member.

6. A mixing container comprising a mating pair of connected first and second chamber members, said first chamber member having a threaded port, a first frangible member sealingly closing an inner end of said port, said second chamber member having a threaded neck adapted for threadedly engaging said port, a second frangible member sealingly closing an outer end of said neck, and a breaking member on said first frangible member for breaking said second frangible member, wherein said neck is partially advanced in said port to a first position from which said neck can be threadedly advanced in said port to a threadedly engaged second position by twisting of one of said first and second chamber members relative to the other of said first and second chamber members to thereby effect breakage of said first frangible member by said neck and to effect breakage of said second frangible member by said breaking member on said first frangible member to allow flow of contents between said first and second chamber members, the mixing container further comprising a label applied to both said first and second chamber members thereby holding said neck in said first position, wherein said label is perforated along a junction of said first and second chamber members.

7. A mixing container according to claim 6 further comprising a bead ring molded integrally with one of said first and second chamber members for sealing the threaded connection of said first and second chamber members at said second position.

8. A mixing container according to claim 6 further comprising mating ratchet members molded integrally on said first and second chamber members for preventing unscrewing of said first and second chamber members.

9. A mixing container according to claim 6 wherein said first frangible member is molded integrally with said first chamber member.

10. A mixing container according to claim 6 wherein one of said first and second chamber members comprises a bowl of cereal and wherein an other of said first and second chamber members contains milk.

11. A mixing container according to claim 6 wherein said port has a cylindrical wall, said first chamber member has a cylindrical wall which extends beyond said port cylindrical wall a distance equal substantially to a height of said neck, said first chamber member has a wall which extends between said port cylindrical wall and said first chamber member cylindrical wall and which is collapsible to allow screwing of said neck into said port.

12. A mixing container according to claim 6 wherein each of said first and second chamber members is composed of molded plastic and wherein at least one of said first and second frangible members is integrally molded with a respective one of said first and second chamber members.

13. A mixing container according to claim 6 wherein said port has a cylindrical wall, the container further comprising a score line molded into and extending partially around said first frangible member thereby defining a breakaway disc having an unscored hinge portion, said breakaway disc being slanted relative to said port cylindrical wall to allow initial contact by said neck with said breakaway disc at a location opposite said unscored hinge portion.

14. A mixing container comprising at least two chamber members including a first chamber member and a second chamber member, said first chamber member having a threaded port, said second chamber member having a threaded neck which is threadedly receivable in said port to threadedly connect said first and second chamber members, said neck having a terminal opening and a first frangible sealing member sealingly covering said opening, a second frangible sealing member which sealingly closes an inner end of said port and which is frangible as said neck bears against said first frangible sealing member as said neck is threadedly received and advanced in said port, and a member on said first chamber member which is adapted for puncturing said second frangible sealing member as said second frangible sealing member bears against said puncturing member as said neck is threadedly advanced in said port, wherein said neck is received in said port in a position such that twisting one of said first and second chamber members relative to an other of said first and second chamber members threadedly advances said neck in said port to bear against and break said first frangible sealing member and to effect breaking of said second frangible sealing member by said puncturing member, and the container further comprises a label applied to both said first and second chamber members, wherein said label is perforated along a junction of said chamber members, wherein said port has a cylindrical wall, the container further comprising a score line molded into and extending partially around said first frangible member thereby defining a breakaway disc having an unscored hinge portion, said breakaway disc being slanted relative to said port cylindrical wall to allow initial contact by said neck with said breakaway disc at a location opposite said unscored hinge portion.

15. A container according to claim 14 wherein each of said first and second chamber members is composed of molded plastic, and said first frangible sealing member is molded integrally with said first chamber member.

16. A container according to claim 14 further comprising mating ratchet members on said first and second chamber members for preventing unscrewing of said first and second chamber members.

17. A container according to claim 14 wherein said port has a cylindrical wall, said first chamber member has a cylindrical wall which extends beyond said port cylindrical wall a distance equal substantially to a height of said neck, said first chamber member has a wall which extends between said port cylindrical wall arid said first chamber member cylindrical wall and which is collapsible to allow screwing of said neck into said port.

18. A container according to claim 14 wherein one of said first and second chamber members comprises a bowl of cereal and wherein an other of said first and second chamber members contains milk.

19. A container according to claim 14 further comprising a bead ring molded integrally with one of said first and second chamber members for sealing the threaded connection of said first and second chamber members.

* * * * *

UNITED STATES PATENT AND TRADEMARK OFFICE

CERTIFICATE OF CORRECTION

PATENT NO. : 7,377,383 B2
APPLICATION NO. : 11/167437
DATED : May 27, 2008
INVENTOR(S) : John R. Henry It is certified that error appears in the above-identified patent and that said Letters Patent is hereby corrected as shown below:

Column 8,
Line 3, “disc,” should be --disc--.

Column 10,
Line 26, “arid” should be --and--.

Signed and Sealed this

Fifth Day of August, 2008

JON W. DUDAS
*Director of the United States Patent and Trademark Office*